US011746539B2

(12) United States Patent
Hartl

(10) Patent No.: US 11,746,539 B2
(45) Date of Patent: Sep. 5, 2023

(54) CARRIER PLATE FOR A FLOOR, WALL OR CEILING STRUCTURE

(71) Applicant: Infinex Holding GmbH, Haiterbach (DE)

(72) Inventor: Martin Hartl, Horb Isenburg (DE)

(73) Assignee: Infinex Holding GmbH, Haiterbach (DE)

( * ) Notice: Subject to any disclaimer, the term of this patent is extended or adjusted under 35 U.S.C. 154(b) by 0 days.

(21) Appl. No.: 16/836,029

(22) Filed: Mar. 31, 2020

(65) Prior Publication Data

US 2020/0325690 A1 Oct. 15, 2020

(30) Foreign Application Priority Data

Apr. 10, 2019 (DE) ..... 10 2019 109 458.5

(51) Int. Cl.
*E04F 15/08* (2006.01)
*E04F 15/02* (2006.01)
*E04F 15/18* (2006.01)

(52) U.S. Cl.
CPC .. *E04F 15/02194* (2013.01); *E04F 15/02133* (2013.01); *E04F 15/185* (2013.01)

(58) Field of Classification Search
CPC ..... E04F 15/18; E04F 15/185; E04F 15/182; E04F 15/186; E04F 15/02194; E04F 15/02133; E02D 31/02
USPC .... 52/302.1, 302.3, 384–390, 408, 409, 411, 52/169.5
See application file for complete search history.

(56) References Cited

U.S. PATENT DOCUMENTS 1,277,622 A * 9/1918 Madison ..... E04D 11/02 52/408
1,867,897 A * 7/1932 Stanbrough ..... E04F 13/0862 52/388
1,965,282 A * 7/1934 Ellithorpe ..... E04F 13/12 52/385
2,391,997 A * 1/1946 Noble ..... E04C 2/326 52/578

(Continued)

FOREIGN PATENT DOCUMENTS

DE 197 50 277 A1 5/1999
DE 10 2006 004 626 A1 8/2007

(Continued)

*Primary Examiner* — Kyle J. Walraed-Sullivan
(74) *Attorney, Agent, or Firm* — Renner, Otto, Boisselle & Sklar, LLP

(57) ABSTRACT

The invention relates to a carrier plate for a floor, wall or ceiling structure, which has a film-like plate (12) made of plastic having a plurality of protrusions (14), having an adhesion-enhancing layer (26) on a first plate side (17), having a further layer (29), which engages with a second plate side (18) opposite the first plate side (17), wherein the further layer (29) is in contact with the protrusions (14), which spans recesses (19) provided in between, wherein the protrusions (14) are formed to protrude alternately from a central plane (16) of the film-like plate (12), such that a plurality of rows and columns is formed, in which protrusions (14) and recesses (19) are alternately lined up and only recesses (19) are lined up along one diagonal (21) to the rows and columns in a direction along the diagonal (21) and only protrusions (14) are lined up at right angles to the diagonal (21) along a further diagonal (22).

11 Claims, 1 Drawing Sheet

(56) References Cited

Figure 1:
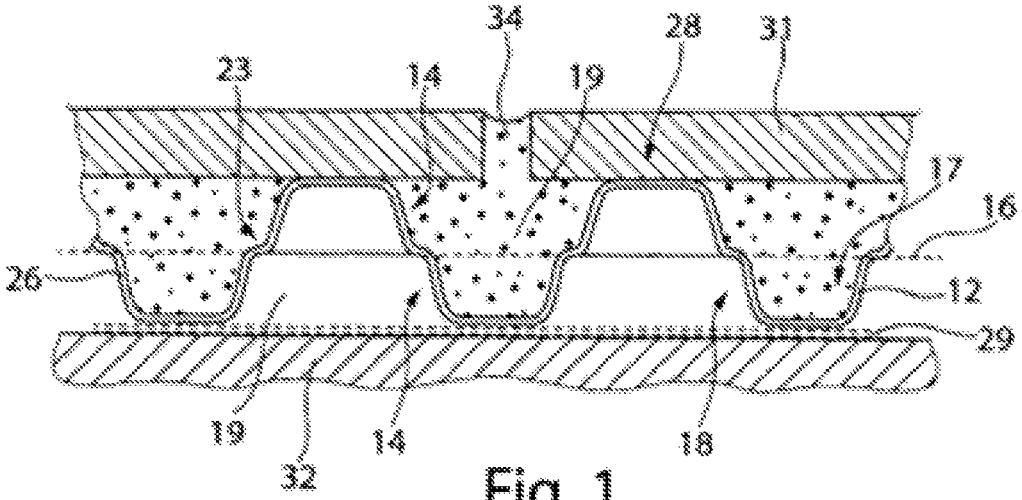

U.S. PATENT DOCUMENTS 2,755,882 A * 7/1956 Maccaferri ..... E04B 1/8409 181/284
2,956,785 A * 10/1960 Richl ..... F24D 5/10 165/56
3,086,899 A * 4/1963 Ingraham ..... E04C 2/3405 428/158
3,231,454 A * 1/1966 Williams ..... F16F 9/0481 428/132
3,369,958 A 2/1968 Fleeman
3,419,457 A * 12/1968 Bleasdale ..... B29D 24/00 428/124
3,444,034 A * 5/1969 Hewett ..... B29C 49/0047 428/72
3,845,593 A * 11/1974 Zen ..... E04C 2/288 52/144
3,865,679 A * 2/1975 Hale ..... E04C 2/3405 428/105
3,876,492 A * 4/1975 Schott ..... B32B 27/12 52/789.1
3,888,087 A * 6/1975 Bergsland ..... E02D 31/02 405/36
4,517,782 A * 5/1985 Shamszadeh ..... E04B 5/40 428/319.1
4,637,184 A * 1/1987 Radtke ..... E04F 15/02429 52/220.4
4,640,854 A * 2/1987 Radtke ..... E04F 15/182 428/34.1
4,730,953 A * 3/1988 Tarko ..... E02D 31/02 405/45
4,789,578 A * 12/1988 Twyford ..... B32B 11/10 428/40.3
4,890,433 A * 1/1990 Funaki ..... E04F 13/0803 52/386
4,917,933 A * 4/1990 Schluter ..... E04B 1/762 428/99
4,956,951 A * 9/1990 Kannankeril ..... B29C 51/22 52/169.5
5,042,569 A * 8/1991 Siegmund ..... F24D 3/143 165/56
5,052,161 A * 10/1991 Whitacre ..... E04F 15/18 52/385
5,255,482 A * 10/1993 Whitacre ..... E04F 15/18 52/385
5,256,007 A * 10/1993 Allen ..... E01C 3/006 405/16
5,383,314 A * 1/1995 Rothberg ..... E02D 31/02 405/43
5,390,467 A * 2/1995 Shuert ..... B29C 51/10 156/292
5,470,641 A * 11/1995 Shuert ..... B29C 51/10 108/57.27
5,566,522 A * 10/1996 Ålander ..... E04B 5/40 428/183
5,572,842 A * 11/1996 Stief ..... E04F 15/02429 52/144
5,619,832 A * 4/1997 Myrvold ..... E02D 31/02 52/403.1
5,761,867 A * 6/1998 Carling ..... E01C 13/045 52/177
5,775,039 A * 7/1998 McPherson ..... E04B 1/7023 52/169.5
5,822,937 A * 10/1998 Mahony ..... F01K 25/065 52/366
5,927,033 A * 7/1999 Kreckl ..... E04F 13/0883 52/390
6,131,005 A * 10/2000 Ozawa ..... E04C 2/32 108/57.26
6,151,854 A * 11/2000 Gutjahr ..... E04D 13/0477 52/385
6,286,279 B1 * 9/2001 Bean ..... A47G 27/0468 52/390
6,343,451 B1 * 2/2002 Chih ..... B32B 3/30 52/312
6,434,901 B1 * 8/2002 Schluter ..... E02D 5/801 52/302.1
6,547,280 B1 * 4/2003 Ashmead ..... F16F 7/121 280/751
6,691,472 B2 * 2/2004 Hubert ..... E02D 31/02 405/107
6,786,013 B2 * 9/2004 Coulton ..... B32B 3/28 405/45
7,249,662 B2 * 7/2007 Itou ..... F16F 7/12 188/371
7,416,775 B2 * 8/2008 Snel ..... B31D 3/002 428/178
7,614,193 B2 * 11/2009 Turner ..... E04F 15/02183 52/385
7,648,058 B2 * 1/2010 Straza ..... B23K 1/20 228/193
7,753,254 B2 * 7/2010 Straza ..... B23K 1/008 228/193
8,458,987 B2 * 6/2013 Becker ..... B32B 27/08 428/172
8,516,760 B2 8/2013 Julton
8,695,300 B2 4/2014 Hartl
9,279,258 B2 * 3/2016 Cormier ..... B32B 27/08
9,925,736 B2 * 3/2018 Cox ..... B32B 3/30
10,011,990 B2 * 7/2018 Collins ..... E04C 2/06
2001/0018816 A1 * 9/2001 Hoepker ..... E04B 5/40 52/783.17
2002/0002937 A1 * 1/2002 Modesitt ..... B65D 19/0002 108/57.34
2003/0154676 A1 * 8/2003 Schwartz ..... A47G 27/0293 52/391
2004/0040257 A1 * 3/2004 Bui ..... E04C 2/326 52/782.1
2004/0076474 A1 * 4/2004 Parker ..... E02D 31/02 405/49
2006/0201092 A1 * 9/2006 Saathoff ..... E04F 13/047 52/385
2006/0260233 A1 * 11/2006 Schluter ..... E04F 15/18 52/302.3
2009/0044470 A1 * 2/2009 Cheetham ..... B32B 5/18 52/309.1
2011/0104434 A1 * 5/2011 Masanek, Jr. ..... E01C 5/20 428/137
2011/0135852 A1 * 6/2011 Sawyer ..... E01C 3/06 428/17
2011/0232217 A1 * 9/2011 Hartl ..... E04F 15/18 52/309.1
2013/0011609 A1 * 1/2013 Comitale ..... B32B 27/32 428/141
2013/0071625 A1 * 3/2013 Masanek, Jr. ..... B32B 3/263 428/172
2013/0111836 A1 * 5/2013 Masanek, Jr. ..... E01C 5/226 52/302.1
2013/0189034 A1 * 7/2013 Herbert ..... B09C 1/005 405/43
2014/0199509 A1 * 7/2014 Dusar ..... B32B 15/046 428/43
2014/0298751 A1 * 10/2014 Sato ..... E04F 15/185 52/741.3
2015/0239199 A1 * 8/2015 Weber ..... B32B 7/08 428/99
2017/0175389 A1 * 6/2017 Liang ..... E04B 5/48
2017/0292278 A1 * 10/2017 Gutjahr ..... B32B 5/024
2019/0100925 A1 * 4/2019 Pucilowski ..... E04F 15/185
2020/0141131 A1 * 5/2020 Cormier ..... E04H 3/10
2020/0141132 A1 * 5/2020 Cormier ..... E04F 15/225

FOREIGN PATENT DOCUMENTS

DE 20 2011 110 801 U1 6/2016
EP 2 231 941 B1 9/2010

* cited by examiner

CARRIER PLATE FOR A FLOOR, WALL OR CEILING STRUCTURE

This application claims priority to German Patent Application No. 10 2019 109 458.5 filed on Apr. 10, 2019, which is hereby incorporated herein by reference.

The invention relates to a carrier plate for a floor, wall or ceiling structure according to the preamble of claim 1.

A carrier plate for integration into a floor construction is known from EP 2 231 941 B1. This carrier plate consists of a film-like plate made of plastic having a plurality of protrusions and recesses. On a first plate side of the film-like plate, an adhesion-enhancing layer is applied, which follows the contours of the first plate side. A further layer can be provided on an opposite plate side, which abuts the protrusions and spans the recesses.

The protrusions in the film-like plate are formed on one side, i.e. protrusions are introduced from a flat film-like plate on one side, wherein the recesses form between the protrusions.

The object of the invention is to create a carrier plate which enables an improved decoupling to a supporting surface.

This object is solved by a carrier plate, by means of which the protrusions are formed so that they protrude alternately from one plane of the film-like plate, such that a plurality of rows and columns is formed, in which protrusions and recesses are alternately lined up, and only recesses are lined up along one diagonal to the rows and columns, and only protrusions are lined up in a further diagonal. Such a design of the carrier plate enables an increased support surface or contact surface to the supporting surface as well as to a cladding applied to it, since by forming protrusions on both sides, an increased number of nubs can be created alternately from the centre plane of the film-like plate. The protrusions extend in the one direction and in the other direction perpendicular to the plane of the film-like plate, such that the elevations and recesses are adjacent to each other, whereby an improved decoupling performance is enabled.

A preferred design of the carrier plate provides that the protrusions formed alternately from the plane of the film-like plate are formed like truncated cones. This has the advantage that contact surfaces are created at the respective end faces of the protrusions in order to accommodate a surface covering, such as a floor covering. Alternatively, truncated pyramid-shaped protrusions can also be provided.

It is preferably provided that along a diagonal, in which recesses are lined up, a crosspiece is provided between two recesses. Advantageously, a crosspiece is analogously provided along the further diagonals, along which the protrusions extend, between two protrusions. These crosspieces are preferably located in the central plane. At the respective crossing point of the diagonals, the respective crosspieces form a common connecting section, the outer edge regions of which are formed and limited by the adjoining recesses or protrusions.

Furthermore, it is preferably provided that a star-shaped connecting section is formed between protrusions and recesses assigned to each other in the central plane. This allows an even force transfer into all protrusions and recesses adjacent to the star-shaped connecting section.

Furthermore, it is preferably provided that the protrusions extend alternately to the central plane at the same height. In particular, a height starting from the central plane of less than 5 mm, in particular less than 3 mm, is provided.

Furthermore, in order to increase the load capacity or payload, it is provided that the number of nubs is greater than 9,000 units/sqm. Preferably, more than 20,000 protrusions per square metre are provided, in particular 22,500 or 25,600 protrusions per square metre. By way of example, the number of protrusions can be in a range between 22,500 to 90,000 nubs/protrusions per square metre. This number comprises all protrusions protruding from the central plane on both the first side of the plate and the second side of the plate.

Furthermore, it is preferably provided that the front surface of the protrusions has a diameter of 3 to 8 mm. This allows a maximum bearing surface and a sufficient force dissipation over the inclined surfaces of the protrusions.

In particular, the film-like plate of the carrier plate is formed of LDPE (low-density polyethylene). This soft and elastic material enables improved decoupling. The carrier plate can also be formed of HDPE (high-density polyethylene), PE (polyethylene) or PP (polypropylene). Preferably, a thickness of the film-like plate of from 0.1 to 2 mm is used.

A fleece or felt is preferably provided as an adhesion-enhancing layer which follows the contours of the first plate side. This allows the adhesive to bond with the fleece or felt when an adhesive is applied to fix a surface support.

Preferably, the carrier plate having the adhesion-enhancing layer provided thereupon and the further layer has a surface weight of from 400 g/m$^2$ to 700 g/m$^2$, preferably of from 500 to 600 g/m$^2$.

Furthermore, it is preferably provided that the further layer on the second plate side is a fleece, a felt, a textile material, a mesh-like fabric or net-like fabric or a perforated layer. This allows for ventilation between the supporting surface and the film-like plate.

This carrier plate according to one of the embodiments described above is preferably used for decoupling a surface covering on a supporting surface to be built on. In this way, a decoupling of tensions between the surface covering and the supporting surface can be made possible. In addition, a sound decoupling, in particular impact sound decoupling, can also be provided.

Figure 2:
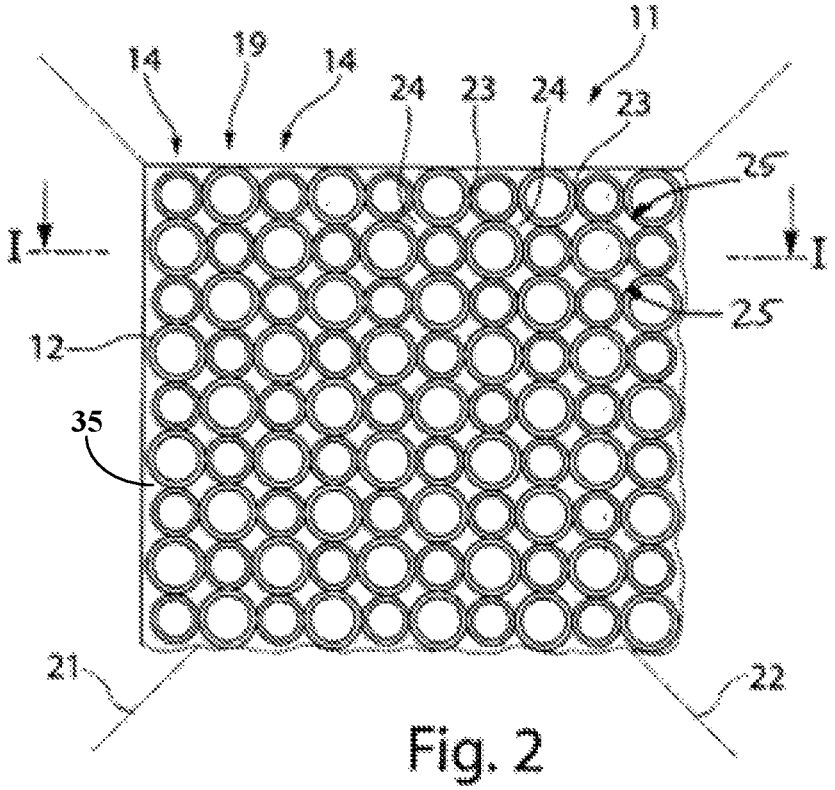

The invention and other advantageous embodiments and developments of the same are described and explained in more detail below using the examples depicted in the drawings. The features to be inferred from the description and the drawings can be applied individually or in any combination in accordance with the invention. They show:

FIG. 1 a schematic sectional depiction of the carrier plate in an installation position for decoupling a surface covering from a supporting surface, and FIG. 2 a schematic view of the carrier plate according to FIG. 1.

FIG. 1 shows a schematic sectional view of a carrier plate 11, which is depicted in a top view in FIG. 2. This carrier plate 11 consists of a film-like plate 12 made of plastic, which has a plurality of protrusions 14. These protrusions 14 are formed on both sides relative to a central plane 16, wherein the central plane 16 corresponds to the plane of the film-like plate 12 in the unfinished state. The protrusions 14 are thus formed alternately to form a first plate side 17 and a second plate side 18 of the film-like plate 12. The protrusions 14 and recesses 19 are arranged alternately in rows and columns. This emerges from the top view in FIG. 2. Along a first diagonal line 21, recesses 19 are provided. Between two recesses 19, a crosspiece 25 extends, which is preferably located in the central plane 16. In a further diagonal 22, offset by 90° to diagonal 21, protrusions 14 are lined up. Between two protrusions 14, a crosspiece 25 extends, which is preferably located in the central plane 16.

Due to the formation of protrusions 14 from the central plane 16 on both sides, horizontally formed support sections 23 arise in the central plane 16 seen in the section view. These support sections 23 surround the protrusions 14 annularly when changing from one plate side 17 to the other plate side 18. Seen in the top view, a star-shaped section 24 arises due to the protrusions 14 on both sides of the central plane structure 35 and the alternately arranged protrusions 14 and recesses 19 through the crosspieces 25. This preferably also merges with the crosspieces 23.

On a first plate side 17, an adhesion-enhancing layer 26 is provided. This layer 26 follows the contour of the first plate side 17 and preferably covers it completely. This layer 26 can be glued or laminated or welded on. Preferably, the adhesion-enhancing layer 26 consists of a fleece, in particular made of polypropylene or polyethylene. Alternatively, a preferably fine-meshed woven fabric, a knitted fabric, a textile material or a perforated fleece or a perforated felt can be provided as the adhesion-enhancing layer 26.

A further layer 29 is provided on the second plate side 18 on the front sides 28 of the protrusions 14. This layer 29 spans over the recesses 19 formed between the protrusions 14. This further layer 29 can be a net-like fabric, a fine-meshed fabric, a perforated fleece or similar. This further layer 29 is glued or welded to the front sides 28 of the protrusions 14.

The carrier plate 11 is used, for example, to decouple a surface covering 31 on a supporting surface 32. This is depicted in FIG. 1, for example. The carrier plate 11 is placed on the second side of the plate 18 on the supporting surface 32. Alternatively, this further layer 29 can be adhered to the supporting surface 32. Only a small amount of adhesive is applied, such that the recesses 19 remain free of adhesive or mortar.

Adhesive or mortar 34 is applied on the opposite first plate side 17 in order to fix the surface covering 31 to the carrier plate 11. The surface covering 31 can be formed from individual tiles or slabs, but also as a laminate made of resin or similar.

The carrier plate 11 has an increased load capacity or payload due to the plurality of protrusions 14 formed out of the central plane 16. Preferably, 9,000 protrusions per square metre or more than 20,000 protrusions per square metre are provided. The gradient of the conical wall sections of the protrusions 14 runs to a vertical of the central plane 16, preferably in a range between 10° and 20°. The protrusions 14 extending on both sides opposite the central plane 16 have a height of less than 5 mm. Preferably, the height of the protrusions on both sides of the central plane 16 is the same.

The invention claimed is:

1. A floor construction comprising:

a supporting surface;

a surface covering;

a carrier plate arranged between the supporting surface and the surface covering to space the surface covering from the supporting surface, wherein the carrier plate comprises:

a plate made of plastic having a central plane structure and a plurality of protrusions, wherein the plurality of protrusions are formed to protrude alternately from opposing sides of the central plane structure on both opposite sides of the central plane structure, wherein a first portion of the plurality of protrusions extends from a first plate side and a second portion of the plurality of protrusions extends from a second plate side opposite the first plate side, wherein each protrusion of the first portion results in a corresponding recess on the second plate side, wherein each protrusion of the second portion results in a corresponding recess on the first plate side;

a layer on a first plate side which follows contours of the first plate side, wherein the layer consists of at least one of fleece, felt, or a woven fabric;

a further layer which engages on a second plate side opposite the first plate side, wherein the further layer abuts a portion of the plurality of protrusions protruding on the second plate side, which span recesses provided between the protrusions; and wherein the plurality of protrusions is formed to protrude alternately from a central plane of the plate, wherein the plurality of protrusions extend on both opposite sides of the central plane, such that a plurality of rows and columns are formed, in which protrusions of the plurality of protrusions and recesses are alternately lined up and only recesses are lined up along a diagonal to the plurality of rows and columns in a direction along the diagonal and only protrusions of the plurality of protrusions are lined up at right angles to the diagonal along a further diagonal, wherein the central plane structure includes respective crosspiece regions that extend between and connect recesses along the diagonal, wherein the respective crosspiece regions further extend between and connect protrusions of the plurality of protrusions along the further diagonal and the crosspiece regions are a star-shaped connection section and part of the central plane, wherein support sections surround the protrusion annularly when changing from one plate side to the other and the support sections arise in the central plane, adhesive applied on the layer to fill a portion of a recess on the first plate side corresponding to a protrusion of the second portion, wherein the further layer is attached to the supporting surface to sandwich the further layer between the plate and the supporting surface, wherein the surface covering is attached to the plate via attachment to the adhesive applied on the layer.

2. The floor construction according to claim 1, wherein the plurality of protrusions are formed as truncated cones.

3. The floor construction according to claim 1, wherein the plurality of protrusions extend alternately to the central plane with a same height.

4. The floor construction according to claim 1, wherein a front side of the plurality of protrusions comprises a diameter between 3 to 8 mm.

5. The floor construction according to claim 1, wherein the plate is made of LDPE.

6. The floor construction according to claim 1, wherein the further layer consists of a fleece, felt, textile material, net or mesh fabric or a perforated layer or a perforated fleece.

7. A method for decoupling the surface covering to the supporting surface located thereon, the method including using the carrier plate according to claim 1.

8. The floor construction according to claim 1, wherein the plate has a thickness from 0.1 to 2 mm.

9. The floor construction plate according to claim 1, wherein a height of the plurality of protrusions relative to the central plane is provided which is less than 5 mm.

10. The floor construction according to claim 1, wherein a number of the protrusions in the plurality of protrusions is in a range of 9,000 units/sqm to 90,000 units/sqm.

11. The floor construction according to claim 10, wherein the number of protrusions in the plurality of protrusions is in a range between 25,600 and 90,000 units/sqm.

* * * * *